US005568887A

United States Patent [19]

Gollihue et al.

[11] Patent Number: 5,568,887

[45] Date of Patent: Oct. 29, 1996

[54] CEILING INSTALLER TOOL HOLDER

[76] Inventors: Charles Gollihue; Brenda Gollihue, both of 169A Center St., P.O. Box 418, Seville, Ohio 44273

[21] Appl. No.: 249,705

[22] Filed: May 26, 1994

[51] Int. Cl.[6] ..... A45F 3/00

[52] U.S. Cl. ..... 224/661; 224/904; 224/222; 224/671; 224/674; 224/679; 224/680; 224/682; 224/683

[58] Field of Search ..... 224/904, 222, 224/223, 224, 225, 226, 232, 234, 249, 251, 272, 919

[56] References Cited

U.S. PATENT DOCUMENTS

| | | | |
|---|---|---|---|
| 2,388,811 | 11/1945 | Zatko | 224/225 |
| 2,758,798 | 8/1956 | Schmidt | 224/904 |
| 4,303,239 | 12/1981 | Walsh, Jr. | 224/904 |
| 4,330,073 | 5/1982 | Clark | 224/223 |
| 4,523,702 | 6/1985 | Viio | 224/904 |
| 4,852,782 | 8/1989 | Wu et al. | 224/226 |
| 4,917,281 | 4/1990 | Ostermiller | 224/904 |
| 4,986,459 | 1/1991 | Yarbrough, Jr. | 224/904 |
| 5,067,643 | 11/1991 | McKinney | 224/206 |
| 5,201,448 | 4/1993 | Schue | 224/904 |
| 5,341,975 | 8/1994 | Marinescu | 224/904 |

FOREIGN PATENT DOCUMENTS

| | | | |
|---|---|---|---|
| 1294937 | 4/1962 | France | 224/919 |

*Primary Examiner*—Henry J. Recla
*Assistant Examiner*—Gregory M. Vidovich

[57] ABSTRACT

A holder for carrying ceiling grid members and ceiling installation tools and supplies. The holder first and second cylinders suspended from a waist strap for receiving the ceiling grid members. A waste cylinder is coupled to the first cylinder and is operable to receive waste grid members resulting from a cutting procedure. A plurality of pouches and loops are coupled to the cylinders for supporting various ceiling installation tools such as a rivet gun, tape measure, saw, circle cutter, chalk line, and the like.

7 Claims, 4 Drawing Sheets

CEILING INSTALLER TOOL HOLDER

BACKGROUND OF THE INVENTION

1. Field of the Invention

The present invention relates to tool belts and more particularly pertains to a ceiling installer tool holder which may be utilized for carrying ceiling grid members and ceiling installation tools and supplies.

2. Description of the Prior Art

The use of tool belts is known in the prior art. More specifically, tool belts heretofore devised and utilized for the purpose of carrying tools and supplies are known to consist basically of familiar, expected and obvious structural configurations, notwithstanding the myriad of designs encompassed by the crowded prior art which have been developed for the fulfillment of countless objectives and requirements.

For example, a pocket member for a tool belt is illustrated in U.S. Pat. No. 4,993,614 which includes one or more separate tool holding members, each capable of holding several tools. Each of the tool holding members is detachably secured to the belt, whereby it can be removed and replaced by a substitute holding member of similar design equipped with different tools.

Another patent of interest is U.S. Pat. No. 5,152,443 which teaches a multi-segmented utility belt employing a plurality of substantially rigid sections connected by flexible portions. Thus, a variety of different tool holders can be pivotally and rotatably supported from the belt.

Other known prior art tool holders include U.S. Pat. No. 4,621,753; U.S. Pat. No. 4,645,1047; and U.S. Pat. No. 4,300,708.

While these devices fulfill their respective, particular objectives and requirements, the aforementioned patents do not disclose a holder for carrying ceiling grid members and ceiling installation tools and supplies which includes first and second cylinders suspended from a waist strap for receiving the ceiling grid members, a waste cylinder coupled to the first cylinder for receiving waste grid members resulting from a cutting procedure, and a plurality of pouches and loops coupled to the cylinders for supporting various ceiling installation tools such as a rivet gun, tape measure, saw, circle cutter, chalk line, or the like.

In these respects, the ceiling installer tool holder according to the present invention substantially departs from the conventional concepts and designs of the prior art, and in so doing provides an apparatus primarily developed for the purpose of carrying ceiling grid members and ceiling installation tools and supplies.

SUMMARY OF THE INVENTION

In view of the foregoing disadvantages inherent in the known types of tool belts now present in the prior art, the present invention provides a new ceiling installer tool holder construction wherein the same can be utilized carrying ceiling grid members and ceiling installation tools and supplies. As such, the general purpose of the present invention, which will be described subsequently in greater detail, is to provide a new ceiling installer tool holder apparatus and method which has many of the advantages of the tool belts mentioned heretofore and many novel features that result in a ceiling installer tool holder which is not anticipated, rendered obvious, suggested, or even implied by any of the prior art tool belts, either alone or in any combination thereof.

To attain this, the present invention generally comprises a holder for carrying ceiling grid members and ceiling installation tools and supplies. The inventive device includes first and second cylinders suspended from a waist strap for receiving the ceiling grid members. A waste cylinder is coupled to the first cylinder and is operable to receive waste grid members resulting from a cutting procedure. A plurality of pouches and loops are coupled to the cylinders for supporting various ceiling installation tools such as a rivet gun, tape measure, saw, circle cutter, chalk line, and the like.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new ceiling installer tool holder apparatus and method which has many of the advantages of the tool belts mentioned heretofore and many novel features that result in a ceiling installer tool holder which is not anticipated, rendered obvious, suggested, or even implied by any of the prior art tool belts, either alone or in any combination thereof.

It is another object of the present invention to provide a new ceiling installer tool holder which may be easily and efficiently manufactured and marketed.

It is a further object of the present invention to provide a new ceiling installer tool holder which is of a durable and reliable construction.

An even further object of the present invention is to provide a new ceiling installer tool holder which is susceptible of a low cost of manufacture with regard to both materials and labor, and which accordingly is then susceptible of low prices of sale to the consuming public, thereby making such ceiling installer tool holders economically available to the buying public.

Still yet another object of the present invention is to provide a new ceiling installer tool holder which provides in the apparatuses and methods of the prior art some of the advantages thereof, while simultaneously overcoming some of the disadvantages normally associated therewith.

Still another object of the present invention is to provide a new ceiling installer tool holder for carrying ceiling grid members and ceiling installation tools and supplies.

Yet another object of the present invention is to provide a new ceiling installer tool holder which includes first and second cylinders suspended from a waist strap for receiving ceiling grid members, a waste cylinder coupled to the first cylinder for receiving waste grid members resulting from a cutting procedure, and a plurality of pouches and loops coupled to the cylinders for supporting various ceiling installation tools.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
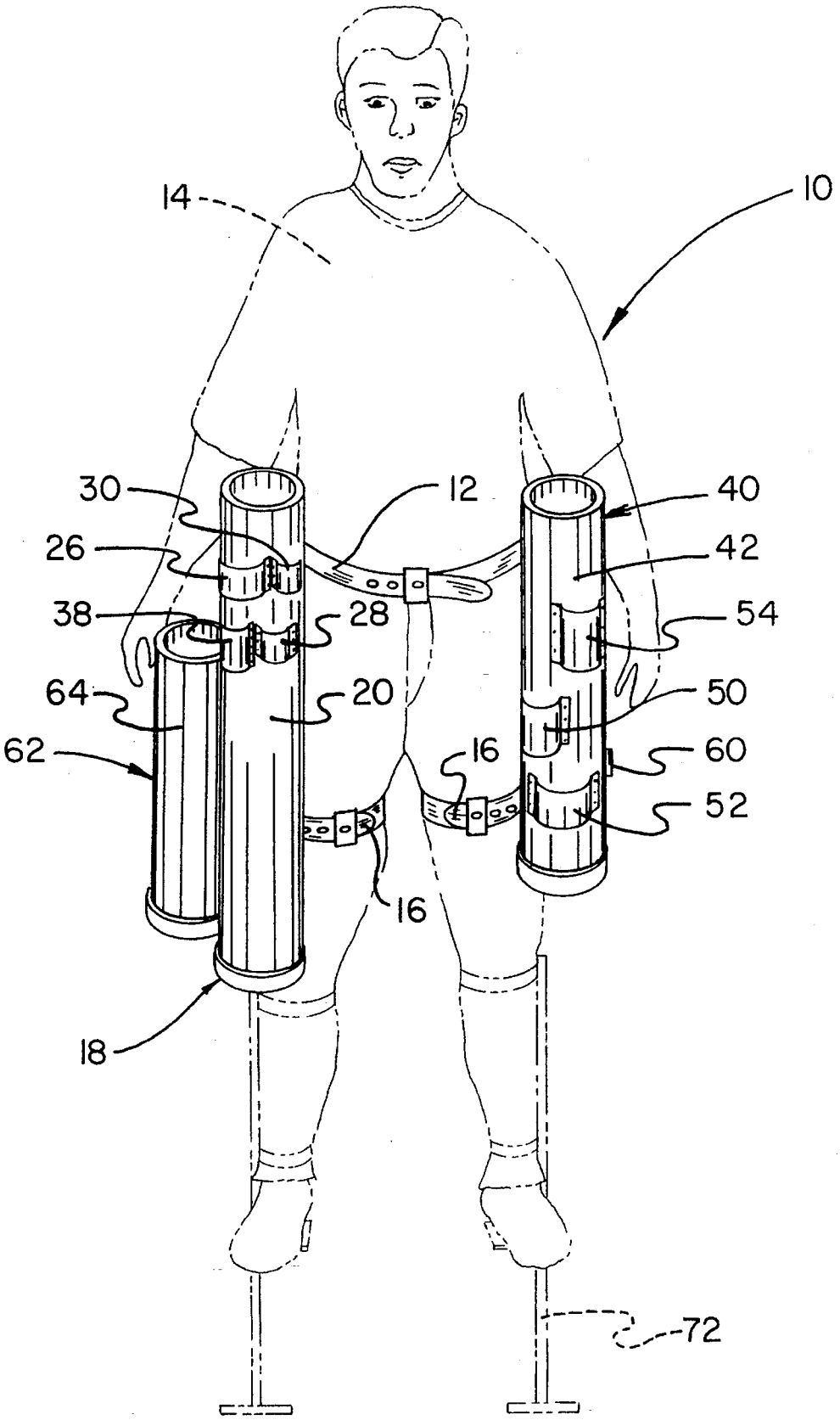
FIG. 1 is a front elevation view of a ceiling installer tool holder comprising the present invention as worn by an individual.

With reference now to the drawings, and in particular to FIGS. 1–9 thereof, a new ceiling installer tool holder embodying the principles and concepts of the present invention and generally designated by the reference numeral 10 will be described.

Figure 4:
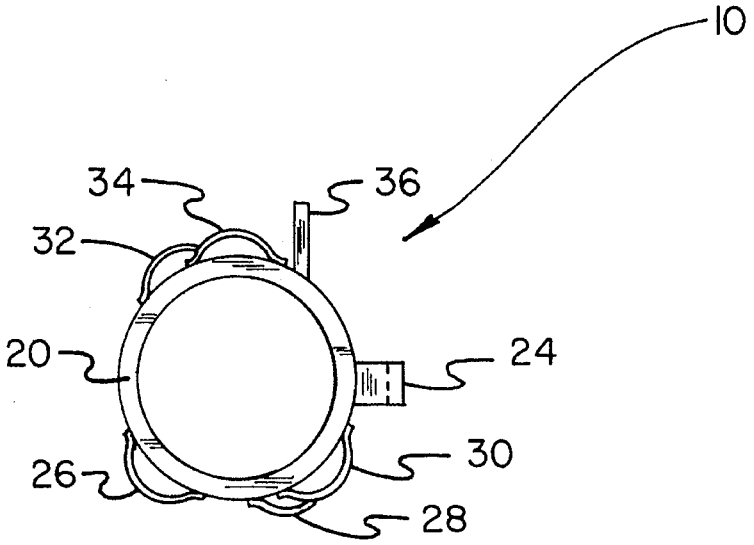
FIG. 4 is a top plan view of the first cylinder.
Figure 2:
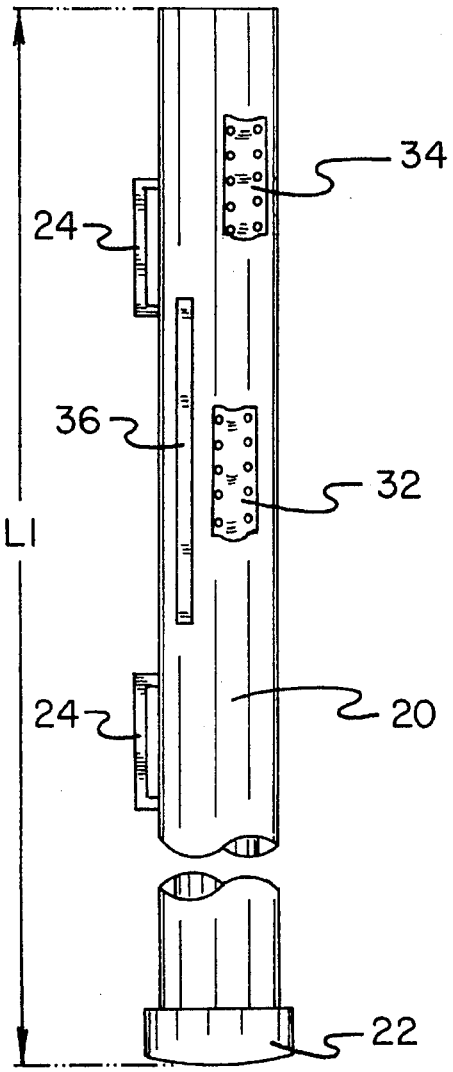
FIG. 2 is a rear elevation view of a first cylinder comprising a portion of the present invention.
Figure 3:
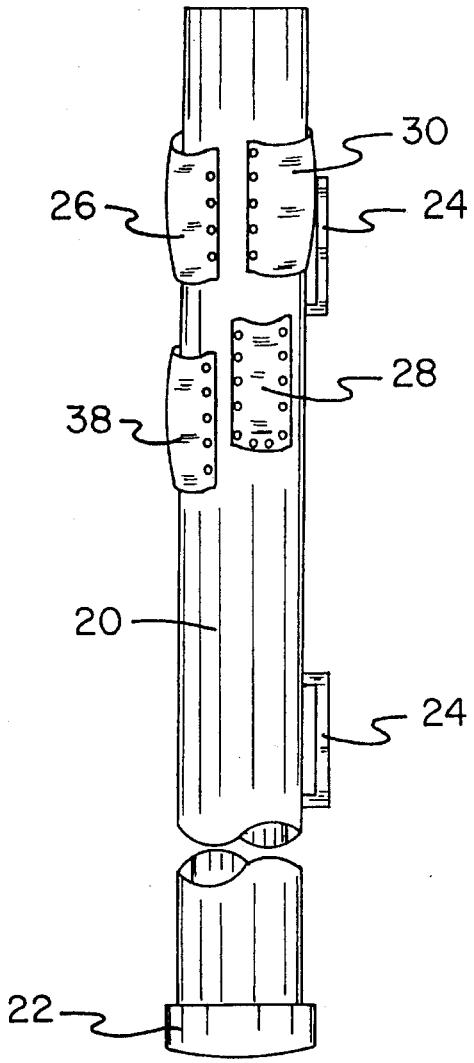
FIG. 3 is a front elevation view of the first cylinder.

More specifically, it will be noted that the ceiling installer tool holder 10 comprises a waist strap 12 or belt which may be worn about the waist of an individual 14 and a pair of legs straps 16 extendable and securable about the thigh portions of the individual, as illustrated in FIG. 1. Slidably coupled to both the waist strap 12 and a first leg strap 16 is a first grid member storage means 18 for carrying ceiling grid members or T-members which are utilized in the construction and repair of suspended or dropped ceilings. The first grid member storage means 18 comprises a first cylinder 20 having a first length "L1" suitable for receiving ceiling grid members. The first cylinder 20 is preferably, but not necessarily, constructed of a length of tubing, such as PVC tubing or the like, having an end cap 22 secured to a lower end thereof to define the closed first cylinder. As best illustrated in FIGS. 2 through 4, the first cylinder 20 is slidably mounted to the straps 12, 16 by a pair of spaced strap mounts 24 through which the straps slidably extend. Thus, the first cylinder 20 may be positioned laterally with respect to the individual 14, as illustrated in FIG. 1, or alternatively may be positioned in other orientations such as posteriorly or anteriorly as desired.

With continuing reference to FIGS. 2 through 4, it can be shown that the first cylinder 20 further includes a snip loop 26 for receiving metal snips or shears, a knife and pencil pouch 28 for receiving knives and/or pencils, a nipper loop 30 for receiving a pair of ceiling grid nippers, a saw loop 32 for receiving a ceiling grid hand saw, and a wicket punch loop 34 for receiving a ceiling grid wicket punch tool. The loops and pouch 26–34 are secured to the first cylinder 20 by a plurality of fasteners, such as rivets, screws, snaps, or the like. In addition, a clamp holder 36 comprising an elongated rail member is mounted to the first cylinder 20 and is operable to have clamps clipped thereto for retention purposes. Lastly, the first cylinder 20 includes a circle cutter loop 38 of substantially similar construction relative to the remaining loops 26 and 30–34 which is operable to receive a circle cutter.

Figure 7:
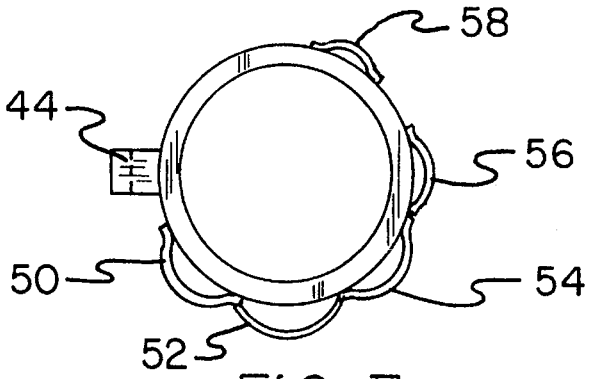
FIG. 7 is a top plan view of the second cylinder.
Figure 5:
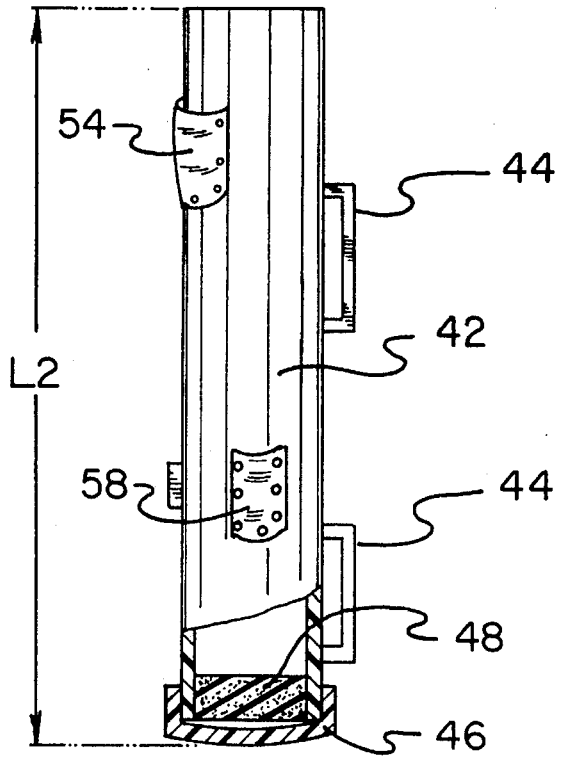
FIG. 5 is a rear elevation view, partially in cross section, of a second cylinder comprising a further portion of the present invention.
Figure 6:
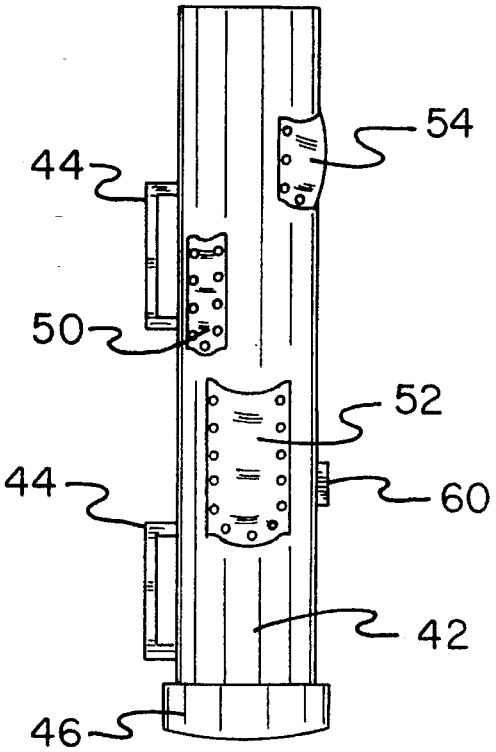
FIG. 6 is a front elevation view of the second cylinder.

Turning now to FIGS. 5 through 7, with concurrent reference to FIG. 1, it can be shown that the ceiling installer tool holder 10 further comprises a second grid member storage means 40 for receiving ceiling grid members of a shorter length than those received within the first cylinder 20 of the first grid member storage means 18. The second grid storage means 40 comprises a second cylinder 42 having a length "L2" and a preferably circular or tubular cross section. The second cylinder 42 is slidably mounted to the waist strap 12 and a second of the legs straps 16 in a manner similar to that of the first cylinder 20 by a further pair of strap mounts 44 which are mounted in a longitudinally spaced manner to the second cylinder 42. Preferably, the second cylinder is also constructed of a tubular member, such as a length of PVC tubing or the like, closed at a lower end thereof by a further end cap 46. To preclude scratching, marring, and deforming of the ceiling grid members placed within the cylinders 20, 42, a pad 48 is positioned within the cylinder proximal the lower end thereof, as illustrated in FIG. 5 for the second cylinder.

To impart a tool carrying ability to the second cylinder 42, an auxiliary pouch 50 for receiving auxiliary items, a rivet gun pouch 52 for receiving a rivet gun, a rivet pouch 54 for receiving rivets, a nail pouch 56 for receiving nails, and a chalk line pouch 58 for receiving a chalk line device are provided. The pouches 50–58 are coupled to an exterior of the second cylinder 42 by a plurality of fasteners, such as screws, rivets, snaps, buttons, or the like. In addition, a tape measure clip 60 for engaging and supporting a conventionally known tape measure is also secured to the side of the second cylinder 42, as illustrated in FIG. 6.

Figure 8:
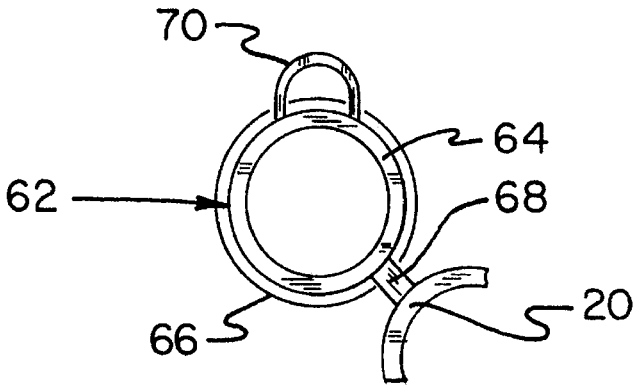
FIG. 8 is a top plan view of a waste cylinder comprising an even further portion of the present invention.
Figure 9:
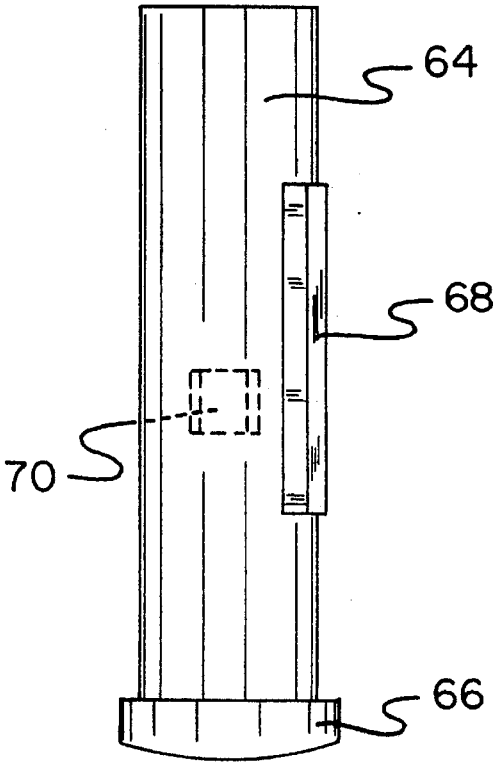
FIG. 9 is front elevation view of the waste cylinder.

Turning now to FIGS. 8 and 9, it can be shown that the ceiling installer tool holder 10 further comprises a waste grid member storage means 62 for receiving waste ceiling grid members resulting from a cutting procedure during installation of the suspended ceiling. The waste grid member storage means 62 comprises a waste cylinder 64 of substantially similar construction to the first and second cylinders 20, 42 and having an end cap 66 defining the closed bottom cylinder thereof. The waste cylinder 64 is coupled to the first cylinder 20 by a joiner 68 which is adhesively or otherwise mechanically coupled to both the first cylinder and waste cylinder, as illustrated in FIG. 8 for example. Preferably, the waste cylinder 64 is positioned laterally and slightly posteriorly of the first cylinder 20 to provide ease of use of the organization 10. In addition, a hammer holder 70 is coupled to an exterior of the waste cylinder 64 for receiving the handle of a conventionally known hammer to support the same in an easily accessible manner.

In use, the ceiling installer tool holder 10 is easily secured to the individual 14 by encircling the straps 12, 16 about the individual's body as illustrated in FIG. 1. The device 30 may then be loaded with ceiling grid members. Typically, ceiling grid members four feet in length are placed within the first cylinder 20 and ceiling grid members of approximately two feet in length are placed within the second cylinder 42. Thus, it is desirable that the length "L1" of the first cylinder 20 be substantially greater than the length of "L2" of the second cylinder 42 to accommodate such various lengths of ceiling grid members. Next, the tools listed above may then be positioned into the corresponding pouches 26–34, 38, and 50–58, while clamps are then coupled to the clamp holder 36 and the hammer is positioned in the hammer holder 70, whereby all these tools and supplies are readily accessible by the individual 14, even when standing upon stilts 72, as illustrated in FIG. 1. During installation of the ceiling, it is typical to cut various grid members to fit into spaces such as corners, around ventilating duct work, and the like, thereby resulting in grid member waste scraps which are typically dropped to the floor. The scraps constitute a safety hazard which the present invention 10 avoids by permitting the individual 14 to simply place such waste grid members scraps into the waste cylinder 64 of the waste grid member storage means 62. Thus, safety and efficiency of the ceiling installation procedure are greatly increased.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new ceiling installer tool holder comprising:

a waist strap securable about a waist of an individual;

a first leg strap securable about a thigh portion of a leg of said individual:

a first rigid cylinder coupled to said waist strap and said first leg strap, said first cylinder having a first cylinder longitudinal axis and a first length with said first cylinder longitudinal axis being vertically oriented:

a plurality of first cylinder loops secured,to an exterior of said first cylinder for holding tools related to ceiling installation:

a second leg strap securable about a thigh portion of the other leg of said individual:

a second cylinder coupled to said waist strap and said second leg strap, said second cylinder having a second cylinder longitudinal axis and a second length with said second cylinder longitudinal axis being vertically oriented and wherein said first length of said first cylinder is greater then said second length of said second cylinder;

a plurality of second cylinder pouches secured to an exterior of said second cylinder for holding tools related to ceiling installation;

rigid waste cylinder coupled to said first cylinders, said waste cylinder having a waste cylinder longitudinal axis with said waste cylinder longitudinal axis being vertically oriented;

a first pad positioned within said first cylinder, and a second pad positioned within said second cylinder;

at least one cylinder pouch secured to an exterior of one of said cylinders for holding items related to ceiling installation;

a clamp holder secured to said exterior of said first cylinder for holding a plurality of clamps;

a tape measure clip secured to said exterior of said second cylinder; and a hammer holder secured to an exterior of said waste cylinder.

2. A new ceiling installer tool holder comprising:

a waist strap securable about a waist of an individual;

a first leg strap securable about a thigh portion of a leg of an individual;

a first rigid cylinder coupled to said waist strap and said first leg strap, said first cylinder having a first cylinder longitudinal axis and a first length with said first cylinder longitudinal axis being vertically oriented;

a plurality of loops secured to an exterior of said first cylinder for holding tools related to ceiling installation;

a second leg strap securable about a thigh portion of the other leg of said individual;

a second rigid cylinder coupled to said waist strap and said second leg strap, said second cylinder having a second cylinder longitudinal axis and a second length with said second cylinder longitudinal axis being vertically oriented, wherein said first length of said first cylinder is greater than said second length of said second cylinder;

a plurality of pouches secured to an exterior of said second cylinder for holding tools related to ceiling installation;

a rigid waste cylinder coupled to said first cylinder, said waste cylinder having a waste cylinder longitudinal axis with said waste cylinder longitudinal axis being vertically oriented.

3. The new ceiling installer tool holder of claim 2, wherein a pouch is secured to one of said cylinders for receiving auxiliary items related to ceiling installation.

4. The new ceiling installer tool holder of claim 3, and further comprising a clamp holder secured to said exterior of said first cylinder for holding a plurality of clamps.

5. The new ceiling installer tool holder of claim 4, and further comprising a first pad positioned within said first cylinder, and a second pad positioned within said second cylinder.

6. The new ceiling installer tool holder of claim 5, and further comprising a tape measure clip secured to said exterior of said second cylinder, and a hammer holder secured to an exterior of said waste cylinder.

7. The new ceiling installer tool holder of claim 6, wherein said cylinders are each comprised of PVC tubing with an end cap secured to an end of said PVC tubing.

* * * * *